United States Patent [19]

Kuehne et al.

[11] Patent Number: 5,061,156

[45] Date of Patent: Oct. 29, 1991

[54] BELLOWS-TYPE DISPENSING PUMP

[75] Inventors: Eric R. Kuehne, Cupertino; Donald D. Hester, Milpitas, both of Calif.

[73] Assignee: Tritec Industries, Inc., Mountain View, Calif.

[21] Appl. No.: 525,593

[22] Filed: May 18, 1990

[51] Int. Cl.[5] ..... F04B 45/00; F04B 39/08; F01B 19/00

[52] U.S. Cl. ..... 417/412; 417/18; 417/401; 417/507; 92/44

[58] Field of Search ..... 417/412, 313, 317, 472, 417/473, 507, 28; 91/34, 44

[56] References Cited

U.S. PATENT DOCUMENTS 2,590,275 3/1952 Ryder et al. ..... 92/44
3,787,882 1/1974 Fillmore et al. ..... 417/412
4,483,665 11/1984 Hauser ..... 417/401
4,715,795 12/1987 Habrich et al. ..... 417/507
4,950,134 8/1990 Bailey ..... 417/18

*Primary Examiner*—Richard A. Bertsch
*Assistant Examiner*—Alfred Basichas
*Attorney, Agent, or Firm*—Thomas E. Schatzel

[57] ABSTRACT

A microprocessor controlled bellows-type pump system for the precise and accurate pumping and dispensing of fluids. The pump comprises a longitudinally contracting bellows which is supported from warping under fluid pressure by a support bushing in contact with the inside folds of the bellows. A stepper motor drives the bellows position via a lead screw. A system of four valves: a dispense valve, shut-off valve, vent valve, and suck-back valve, control fluid routing within a manifold. One or two pressure transducers allow the microprocessor to control valve positions and stepper motor turning for well behaved dispensing operations.

16 Claims, 5 Drawing Sheets

4
4
104
100

A
112
102
118
106
114
108
110
116
117
B
130
124
120
132
A
B
144
140
142

BELLOWS-TYPE DISPENSING PUMP

BACKGROUND OF THE INVENTION

1. Field of the Invention

The invention relates generally to metering pumps and specifically to high-precision bellowstype liquid metering pumps with controlled dispense volume and velocity.

2. Description of the Prior Art

Fluid pumps are available in a variety of configurations, including: diaphragm, bellows, and piston actuated versions. Precision metering pumps favor the diaphragm, bellows, and piston types because of their ability to provide a constant flowrate when the volume being dispensed is less than or equal to the maximum volume the pump is capable of dispensing with a single stroke. In piston actuated pumps the fluid being pumped can coat the cylinder walls and get pass the piston, and so these types are not preferred in high purity applications where contamination of the media must be avoided.

In the piston pump, the volume of fluid being pumped is a direct function of the piston area, times the length of the piston stroke, times the number of strokes. Bellows types are similarly determinable. In fluid dispensing for semiconductor manufacture, the fluid delivery must be in a single evenly pressured stream with no pulsations, therefore, no more than a single full stroke is used. This, of course, limits practical dispense volumes to the piston area times the piston stroke. Since the piston area and stroke length are usually fixed by design, the pump delivery is adjustable by the length of the stroke. Precise control of a piston's stroke length is conventionally accomplished by attaching a threaded lead screw to the piston and by driving a threaded nut on the lead screw with a stepper motor. With diaphragm pumps, there is no way of measuring the stroke by distance travelled, thus other means, such as the time multiplied by the force driving the dispense, must be used as approximations.

In FIG. 1(*a*), a diaphragm pump, referred to by the general reference character 10, has an air inlet port 12 that puts a gas 14 behind a diaphragm 16. A fluid 18 is input through a check-valve 20 and output through another check-valve 22. The volume of fluid 18 pumped will depend on the pressure behind gas 14 and the duration of the stroke. It is therefore difficult to get precise fluid 18 metering with pump 10. A second problem with pump 10 is that diaphragm 16 has a short life and must frequently be replaced. This shortness of life is mainly attributable to the differential pressures that exist across the membrane of diaphragm 16 during operation and by the high stresses present at the perimeter/seal. An advantage of pump 10 is that it is simple to manufacture.

A hybrid diaphragm/piston pump is shown in FIG. 1(*b*) and referred to by the general reference character 30. Pump 30 attempts to solve the short diaphragm life problem by placing a non-compressible fluid 32 between a piston 34 and a diaphragm 36. Pump 30 also solves the problem of volume displacement uncertainty by having the piston 34 transfer pumping forces to diaphragm 36. A volume represented by the area of the piston 34 times the stroke length of the piston 34 will be exactly matched by the volumetric displacement of diaphragm 36, and therefore by a fluid 38. Containing the non-compressible fluid 32 behind diaphragm 36 presents a potential for contamination since an absolute perfect seal is virtually impossible to maintain.

A bellows pump is shown in FIG. 1(*c*) and is referred to by the general reference character 50. A bellows 52 rides on a motor shaft 54 that strokes the bellows 52 within the pump 50 and thereby pumps a fluid 56. Ordinarily, the bellows 52 would be constructed of stainless steel, but in ultra-pure chemical pumping operations, the nickel in stainless steel can leach into fluid 56 and ruin semiconductor wafers in production. The semiconductor industry—which is a major user of precision metering pumps—has, therefore, come to demand that all components that come into contact with the fluids, e.g., 18, 38, and 56, be constructed of a material that does not contaminate the fluid, e.g., Teflon®. A bellows 52 made of a material that does not contaminate the fluid, for example Teflon, will however, flex under even moderate pressure, unlike a stainless steel bellows. This flexing changes the effective volume of fluid 56 in pump 50 that will be displaced by bellows 52. Backing the bellows 52 with air pressure would be a solution to the problem, but changing downstream conditions that resist the flow of fluid 56 out of pump 50 are hard to compensate for exactly and any mismatch would imbalance the bellows 52 once again.

Bellows-type fluid pumping systems are well known. For example, U.S. Pat. No. 4,483,665 ('665), by Hauser, describes a displacement type fluid and filtering system that uses a longitudinally contracting bellows and a compressed air driven piston to pump fluid through the system. A suck-back mechanism is shown by Hauser ('665) for preventing fluid from remaining at the nozzle tip after a discharge stroke. Hauser ('665) uses a check valve to relieve pressure that builds up during the discharge stroke and a cartridge filter to filter the fluid before it is discharged. In a related patent by Hauser, U.S. Pat. No. 4,541,455 ('455), there is an automatic vent valve for use with a bellows-type fluid pumping and filtering system. The valve automatically vents gases that build up during the cycling of the bellows-type pump.

Prior art bellows-type chemical pumping systems use open loop control systems. The rate of fluid discharge is controlled by the air flow rate that drives the bellows compression piston. Such systems are open loop because there is no feedback information available to the systems for modulating the air pressure in response to an unsatisfactory rate.

A common fluid dispensed in precision volumes by pumps 10, 30, and 50 is photoresist. Since photoresist contains highly volatile solvents and is prone to outgassing after short standing times, a dribble or positive meniscus on the output nozzle of a pump cannot be allowed to form. If such a dribble or bulge did form and was allowed to stand, it would dry out and drop solid particles in the next dispensing cycle, and would probably ruin the semiconductor wafer being processed. Various schemes have been devised to retract the fluid meniscus. A very practical one places a small chamber with a diaphragm and only one port in a "T" connection with the pump's output nozzle. After the dispensing cycle, the small diaphragm is retracted, causing the suck back of a small volume of fluid from the nozzle, thus causing a negative meniscus, at minimum, that will resist drying out.

Although chemical fluids used in precision metering pumps are quite pure, filters are nevertheless used in association with such pumps. Filter membranes, especially ultra-fine membranes, can be damaged or compromised by (1) attempting to pump air through them, and/or (2) by reverse flowing fluid through the filter. Either case will flex the filter membranes and can cause otherwise trapped contaminants to become dislodged. A simple pump system that consists of one of the pumps shown in FIG. 1 and a filter can flex the filter's membrane when the pump is reversed to effectuate a suck-back. The filter's membrane will also be flexed by air being forced through it when the pump is started for the first time or a new filter cartridge has been installed.

SUMMARY OF THE PRESENT INVENTION

It is therefore an object of the present invention to provide a fluid pumping system with accurate dispense volumes and velocities.

It is a further object to prevent fluid from drying at, and dribble from, the nozzle in a pumping system.

It is a further object to have a very flexible fluid pumping system that can have its operational characteristics easily modifiable.

It is a further object to provide a system tolerant of a wide range of fluid viscosities.

Briefly, a first preferred embodiment of the present invention includes, an input, a check-valve, a bellows-type pump having a stepper motor, a dispense valve, a vent valve, a shut-off valve, a suck-back valve, a filter inlet transducer, a filter outlet transducer, a filter, and a nozzle. Each of the major components is interfaced to a microprocessor. All the components coming into contact with the fluid being metered are constructed of a material that does not contaminate the fluid.

An advantage of the present invention is that accurate volumes and velocities of fluid are dispensed by the pumping system.

Another advantage of the present invention is that the delivered flow begins and ends cleanly and smartly.

Another advantage of the present invention is that no dribble or positive meniscus is left at the nozzle to dry after a dispensing of fluid.

Another advantage is that filter performance is maximized.

These and other objects and advantages of the present invention will no doubt become obvious to those of ordinary skill in the art after having read the following detailed description of the preferred embodiments which are illustrated in the various drawing figures.

IN THE DRAWINGS

FIGS. 1(*a*), 1(*b*), and 1(*c*) are diagrams of three different prior art pumps;

DETAILED DESCRIPTION OF THE PREFERRED EMBODIMENTS

Figure 1:
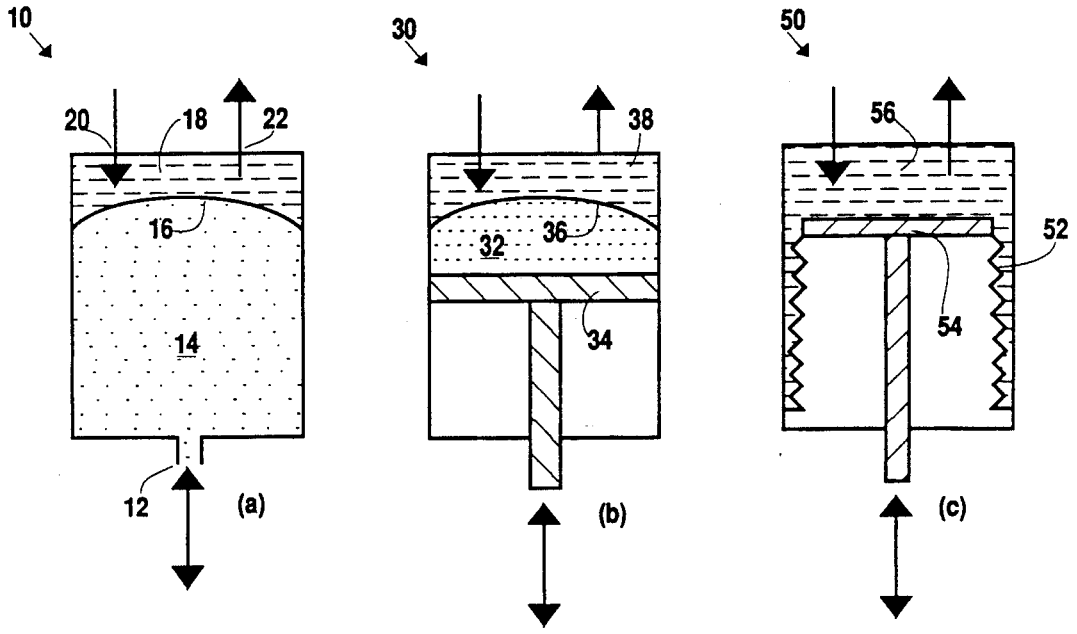
Fig 1 (Prior Art)
Figure 2:
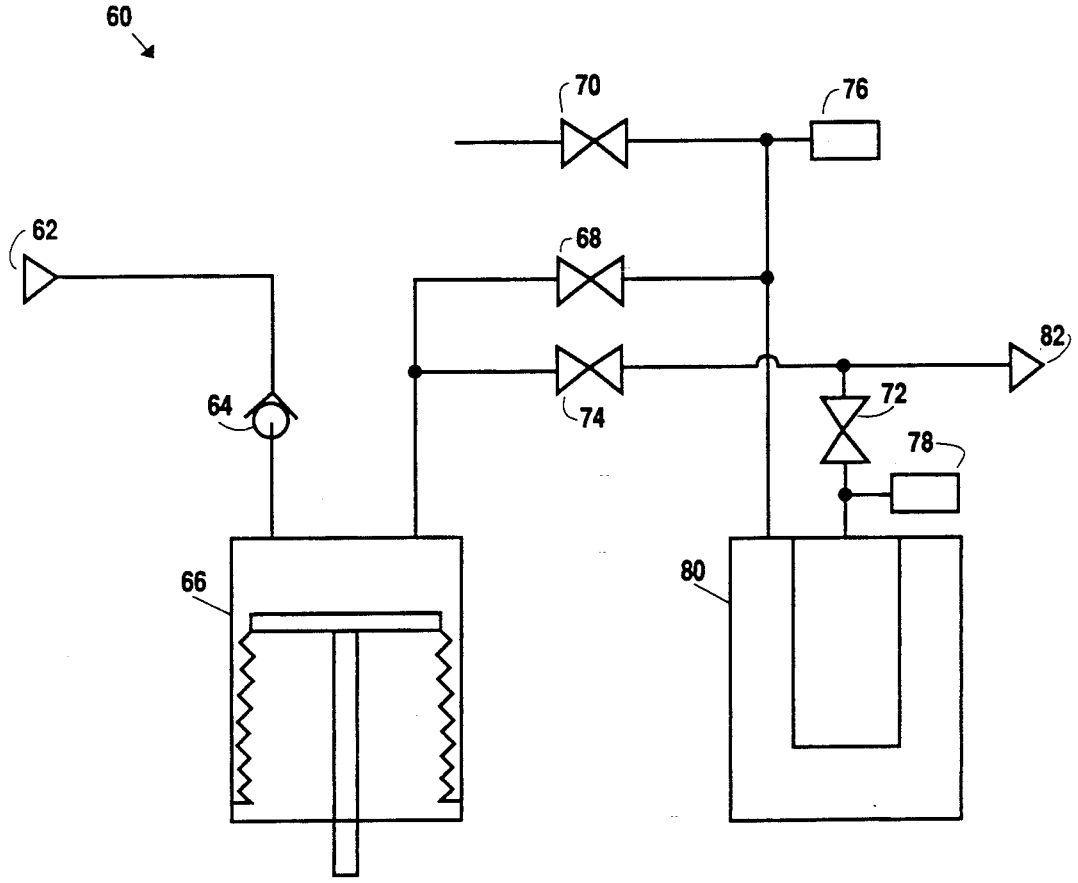
FIG. 2 is a schematic piping diagram of an embodiment of a system of the present invention.

FIG. 2 illustrates a system of the present invention which simultaneously solves the filter flexing and nozzle suck-back problems. The pump system of FIG. 2, referred to by the general reference character 60, has an input 62, a check-valve 64, a bellows-type pump 66, a dispense valve 68, a vent valve 70, a shut-off valve 72, a suck-back valve 74, a filter inlet transducer 76, a filter outlet transducer 78, a filter 80, and a nozzle 82. The pump 66 can be actuated by any suitable motor, or combination motor and positioning means, such as a stepper motor and lead screw (not shown). The flow of a fluid through the filter 80 is always in one direction. If the system 60 is dry, it initially charges with fluid from input 62 by opening vent valve 70 and dispense valve 68, and closing suck-back valve 74 and shut-off valve 72. Fluid is then pumped by pump 66 until fluid escapes through vent valve 70. Valve 72 is then closed. Since vent valve 70 is, by design, the highest point in the system 60, fluid will fill filter 80 by action of gravity. The bellows in pump 66 are purposely advanced prior to a dispense cycle to slightly raise the pressure seen by transducer 78. This slight pressure will cause the fluid to start from nozzle 82 with a uniform stream, rather than a sputter. The dispense cycle is started by opening valves 68 and 72, and continued by pumping action of pump 66. The length of the stroke made by pump 66 will be predetermined by the user according to how much fluid is to be ejected from the nozzle 82 in the dispense phase. The dispense phase ends by closing valve 72, thus causing a clean cut-off of the fluid flow through nozzle 82. The internal pressure on the filter 80 inlet side is relieved by reversing pump 66 with valve 68 open and valve 72 closed until pressure transducer 76 reads zero. The suck-back phase can then be started by opening valve 74 and running pump 66 in reverse. About 0.015 cc is a sufficient suck-back, and that will consist of one or two full steps of the stepper motor (not shown) attached to pump 66. Suck-back therefore does not involve filter 80 and only filtered fluid is actually sucked back into pump 66.

Alternatives that use fewer than two transducers, e.g., zero or one transducer, are practical, and may be preferred in particular situations. For applications not using any transducers, start up and pressure bleed volume values are developed empirically and motor operations that produced the desired pressures in tests are later used in operation to approximate the desired target pressures. In applications using just one transducer located as transducer 76 in FIG. 2, the start up volume is determined empirically. Pressure bleed value is determined to terminate that function as the pressure at transducer 76 location reaches zero PSIG. For applications using just one pressure transducer, located at a place similar to transducer 78 in FIG. 2, start up delay is determined by monitoring the internal pressure increase of pump 66 as the bellows move forward while shut-off valve 72 remains closed. When a predetermined pressure is reached, the shut-off valve 72 opens, initiating dispense. Pressure bleed value is determined to terminate that function as the pressure at transducer 76 location reaches zero PSIG. Having both pressure transducers 76 and 78 avoids having to develop empirical data for use later in approximations. Start up delay is determined by monitoring the internal pressure increase of pump 66 as the bellows move forward while shut-off valve 72 remains closed; pressure bleed value is determined terminating that function as the pressure at transducer 76 location reaches zero PSIG.

Figure 3:
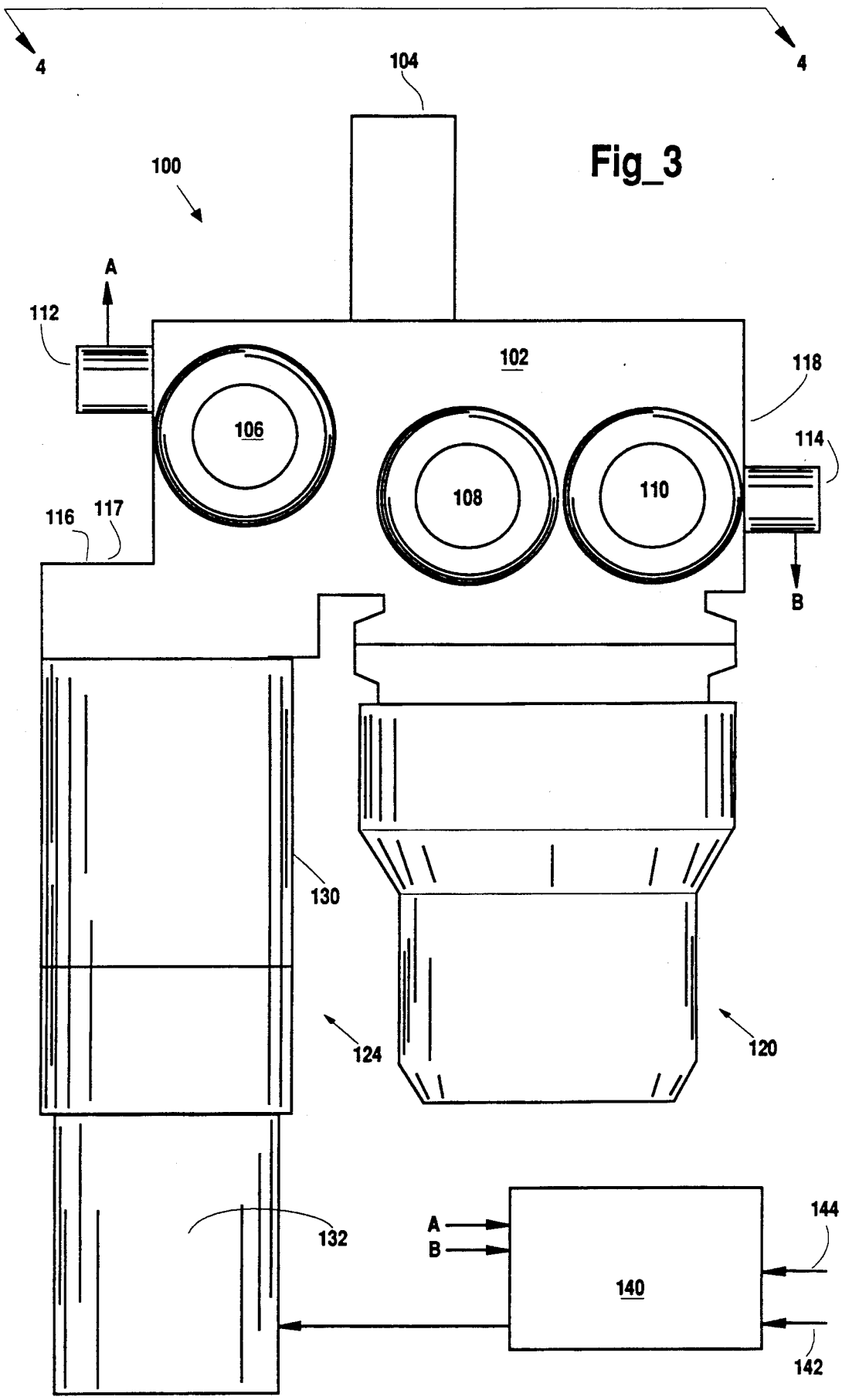
FIG. 3 is a detailed mechanical elevation of the system shown schematically in FIG. 2.

In FIG. 3, a fluid pumping system, referred to by the general reference character 100, is shown. The schematic diagram of FIG. 2 closely parallels the system 100. The valving described above is carried out in a manifold 102 having a vent valve 104, a dispense valve 106, a suck-back valve 108, a shut-off valve 110, a filter input transducer 112, a filter output transducer 114, an input port 116 having a check valve 117, and an output port 118.

Figure 4:
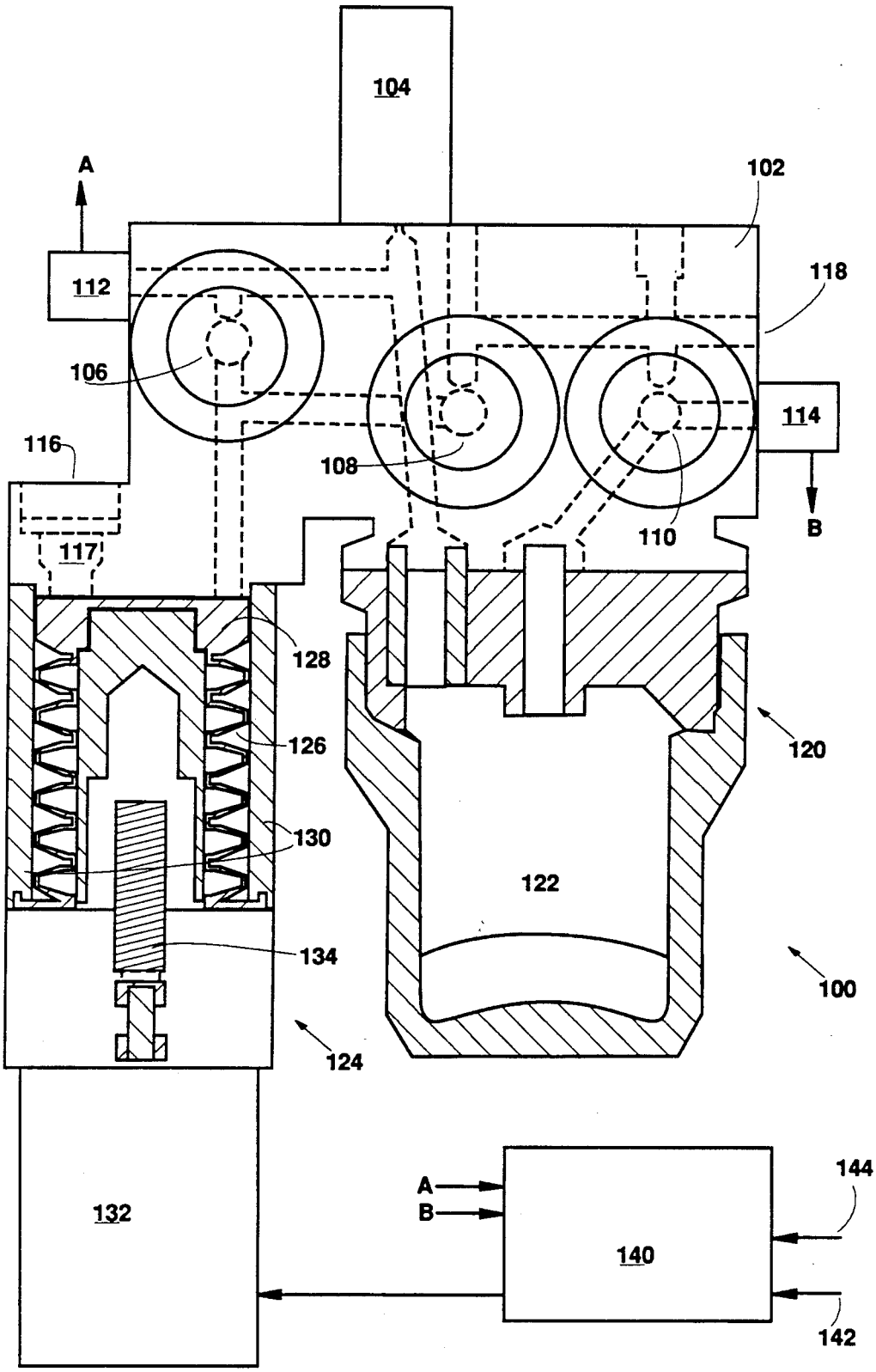
FIG. 4 is a cross-section view of the system taken through the center along the same plane as that of FIG. 3.

FIG. 4 is a cross-section of FIG. 3 taken along line 4—4. Attached to the manifold 102 is a filter assembly 120 having a filter cartridge 122, and a pump assembly 124 comprising a bellows 126, a bellows support bushing 128, a barrel 130, a stepper motor 132, and a lead screw assembly 134. The bellows 126 and barrel 130 are comprised of a material that does not contaminate the fluid. For example, a commercially available material referred to by the trademark Teflon has been found to be preferable. A microprocessor 140 is in communication with transducers 112 and 114; valves 104, 106, 108, 110; and the stepper motor 132. A trigger input 142 to microprocessor 140 will signal the user's request for a dispense of fluid meeting a predetermined user defined parameter. An input 144 to microprocessor 140 allows the user to program stepper motor 132 displacements. The valves 106, 108, and 110 are preferably all air actuated, because fast opening and closing of solenoid-type valves can cause disturbances within system 100 that will adversely affect accurate and well-behaved fluid dispensing.

Figure 5:
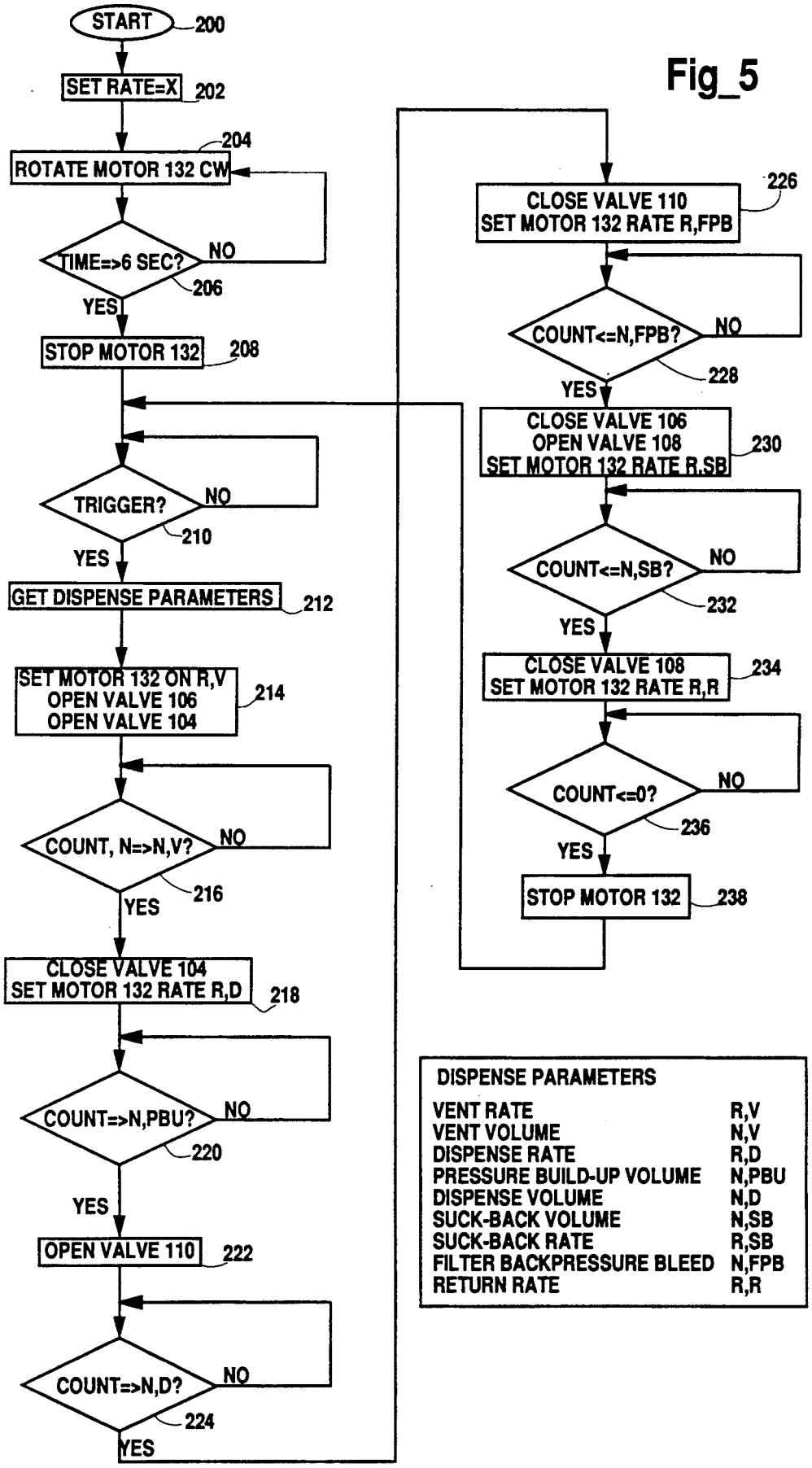
FIG. 5 is an operational flow chart for the microprocessor in control of the system of FIGS. 2–4.

FIG. 5 is a flow chart of an exemplary computer-implemented process executed by microprocessor 140. The actions necessary from microprocessor 140 to control the system 100 includes a plurality of even-numbered process steps 200-234. The process is nearly identical to that described above for system 60 in FIG. 2.

Figure 6:
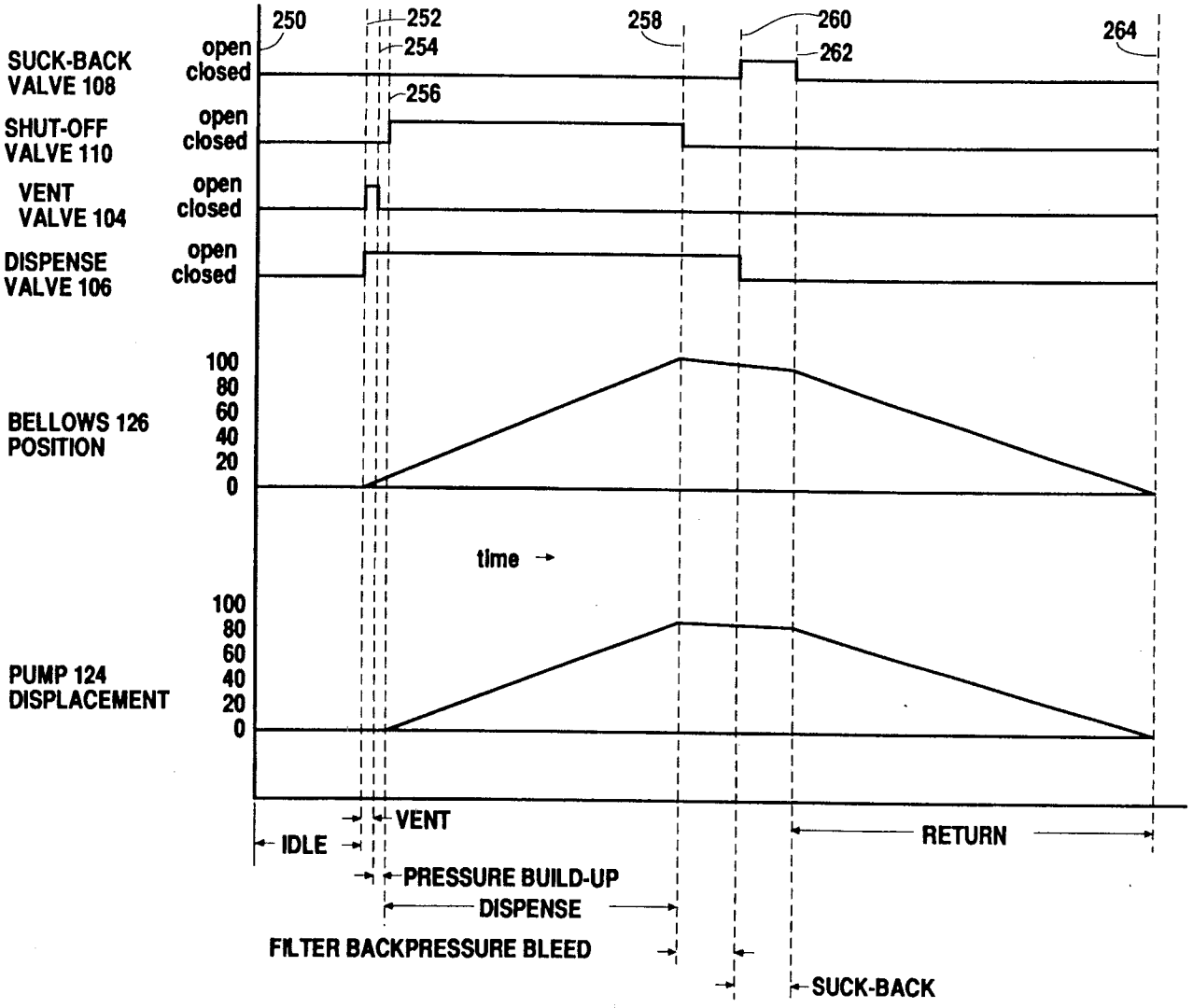
FIG. 6 is a timing diagram of the preferred embodiment in operation.

FIG. 6 shows the timing relationships between the various actions that are described below relative to FIG. 5. Certain critical points in time are marked by a plurality of even-numbered time lines 250-264. The process starts at step 200, which coincides with time line 250. A rate is set to a user predetermined variable "X" in step 202 via input 144. The motor 132 is rotated clockwise in step 204. The motor 132 will continue to rotate for six seconds, then fall through step 206, to where the motor 132 is stopped in step 208. Motor 132 has two operating parameters, (1) the number "N" of stepper-motor steps, and (2) the frequency of those steps which is called the rate "R". A trigger signal, on trigger input 142 provided from the outside user environment, is looked for in step 210. When one is detected the dispense parameters are collected in step 212. Step 214, at time line 252, sets the motor 132 to vent valve rate "R,V", and it opens dispense valve 106 and vent valve 104. Stepper-motor steps are sent to motor 132 and counted. Each step will cause a known volume of liquid in the pump 124 to be displaced, so the vent volume "N,V" will be matched during step 216. At the end of the venting phase, step 218 will cause the vent valve 104 to be closed and the motor 132 to be set to a dispense rate "R,D", at time line 254. A clean delivery of fluid will occur if a slight pressure is built-up, so step 220 counts the number of stepper-motor steps sent to motor 132 that will cause an empirically determined proper volume to be displaced. Alternatively, pressure transducer 114 can sense the pre-dispense pressure that is predetermined by the user. At step 222, time line 256, shut-off valve 110 is opened and delivery of the fluid begins out port 118. At step 224, the motor 132 is motor stepped enough to match the dispense volume "N,D". Shut-off valve 110 will then close in step 226, time line 258, and motor 132 will be set to a filter backpressure bleed rate "R,FPB". Step 228 counts the number of steppermotor steps sent to motor 132, and when that approximates a filter backpressure bleed volume "N,FPB", step 230 will close dispense valve 106 and open suck-back valve 108 at time line 260. Alternatively, the filter backpressure bleed value can be read by transducer 112, and the number of motor 132 steps required will be set by closed loop control. Step 232 counts off stepper-motor steps to motor 132, and when that matches a suck-back volume "N,SB", step 234 will close suck-back valve 108 and set motor 132 to a return rate "R,R", both at time line 262. Motor 132 then returns to a zero point (maximum backward stroke of bellows 128) while step 236 waits for the count to be less than or equal to zero; then falls through to step 238, at time line 264, where motor 132 is stopped. The system's control flow then returns to step 210, and waits for the next trigger on trigger input 142.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A metering pump, comprising:

a barrel having a cylindrical bore having a first end and a second end;

a bellows disposed within said bore of the barrel, the bellows having a plurality of pleats between a first end and second end, said first end attached and forming a seal with the first end of said bore, said second end being longitudinally moveable within said bore;

a support bushing disposed within the bellows and attached to said second end of the bellows and being moveable longitudinally within the inside folds of the plurality of pleats, the inside folds of the plurality of pleats being limited in their ability to radially contract by the outside diameter of the support bushing;

a positioning means for positioning the support bushing and said second end of the bellows within said bore;

an inlet means for inletting dispensing fluid through said second end of said bore; and a dispensing means for outletting said fluid through said second end of said bore.

2. The metering pump of claim 1, wherein:

the positioning means includes a stepper motor and a lead screw attached to the support bushing.

3. The metering pump of claim 1, wherein:

the inlet means comprises a check valve; and the dispensing means comprises a two-way air-actuated valve.

4. The metering pump of claim 1, further including:

a filter in fluid communication with the dispensing means having a filter input and filter output.

5. A metering pump, comprising:

a barrel having a cylindrical bore having a first end and a second end;

a bellows disposed within said bore of the barrel, the bellows having a plurality of pleats between a first end and second end, said first end attached and forming a seal with the first end of said bore, said second end being longitudinally moveable within said bore;

a support bushing disposed within the bellows and attached to said second end of the bellows and being moveable longitudinally within the inside folds of the plurality of pleats;

a positioning means for positioning the support bushing and said second end of the bellows within said bore;

an inlet means for inletting dispensing fluid through said second end of said bore;

a dispensing means for outletting said fluid through said second end of said bore;

a filter in fluid communication with the dispensing means having a filter input and filter output;

an output port in fluid communication with said output of the filter;

a vent valve in fluid communication with and interposed between said input of the filter and a vent port; and a shut-off valve interposed between said output of the filter and the output port.

6. The metering pump of claim 5, wherein:

the vent valve is solenoid actuated and the shut-off valve is air actuated.

7. The metering pump of claim 6, further including:

a suck-back valve in fluid communication with and interposed between the dispensing means and the output port.

8. The metering pump of claim 7, wherein:

the suck-back valve is air actuated.

9. The metering pump of claim 7, further including:

a microprocessor in communication with the suck-back valve, the vent valve, the shut-off valve, the dispensing means, and the positioning means.

10. The metering pump of claim 9, wherein:

the microprocessor is in communication with a pressure transducer in fluid communication with said filter input.

11. The metering pump of claim 9, wherein:

the microprocessor is in communication with a pressure transducer in fluid communication with said filter output.

12. The metering pump of claim 9, wherein:

the microprocessor has a trigger input; a data input; and means for storing computer programs, stepper motor rates, and volume parameter values.

13. A metering pump, comprising:

a barrel having a cylindrical bore having a first end and a second end;

a bellows disposed within said bore of the barrel, the bellows having a plurality of pleats between a first end and second end, said first end attached and forming a seal with the first end of said bore, said second end being longitudinally moveable within said bore;

a support bushing disposed within the bellows and attached to said second end of the bellows and being moveable longitudinally within the inside folds of the plurality of pleats;

a positioning means for positioning the support bushing and said second end of the bellows within said bore;

an inlet means for inletting dispensing fluid through said second end of said bore;

a dispensing means for outletting said fluid through said second end of said bore; and a filter in fluid communication with the dispensing means having a filter input and filter output; and a pressure transducer in fluid communication with said filter input.

14. A metering pump, comprising:

a barrel having a cylindrical bore having a first end and a second end;

a bellows disposed within said bore of the barrel, the bellows having a plurality of pleats between a first end and second end, said first end attached and forming a seal with the first end of said bore, said second end being longitudinally movable within said bore;

a support bushing disposed within the bellows and attached to said second end of the bellows and being movable longitudinally within the inside folds of the plurality of pleats;

a stepper motor and a lead screw connected to the support bushing for positioning the support bushing and said second end of the bellows disposed within said bore;

a check valve in fluid communication with said second end of said bore;

a two-way air-actuated dispensing valve in fluid communication with said second end of said bore;

a filter in fluid communication with the dispensing valve with a filter input and filter output;

an output port in fluid communication with said output of the filter;

a solenoid-actuated vent valve in fluid communication with and interposed between said input of the filter and a vent port;

a two-way air-actuated shut-off valve interposed between said output of the filter and the output port;

a two-way air-actuated suck-back valve in fluid communication with and interposed between said dispensing valve and the output port;

a pressure transducer in fluid communication with said input of the filter; and a pressure transducer in fluid communication with said output of the filter.

15. A method for metered liquid dispensing, comprising:

running a bellows-type pump having a liquid source and a check valve at an input;

opening at an output of said pump a dispense valve and a vent valve and closing a shutoff valve and a suck-back valve whereby gases on an input side of a filter in fluid communication with said pump output are eliminated;

closing said vent valve after a predetermined and selectable interval;

delaying the opening of said shut-off valve after said vent valve closes a predefined and selectable interval such that a relatively slight pressure is present on said pump outlet;

dispensing from an output port a measured volume of liquid by opening said shut-off valve and by running said pump for a pre-determined number of cycles;

ending the dispensing by stopping said pump and by closing said shut-off valves;

running said pump in reverse until the pressure at said pump output is substantially zero;

closing said dispense valve;

opening said suck-back valve;

running said pump in reverse until the liquid in the tip of said output port is drawn slightly back in;

closing said suck-back valve; and running said pump in reverse to return to a zero point

16. The method of claim 15, wherein:

opening and closing said valves is done relatively gently by air actuation.

* * * * *